United States Patent [19]

Anzai et al.

[11] Patent Number: 4,688,924

[45] Date of Patent: Aug. 25, 1987

[54] DOCUMENT COPYING SYSTEM

[75] Inventors: Shunju Anzai; Yoshihisa Miwa, both of Nara; Masakiyo Okuda, Kashiwara, all of Japan

[73] Assignee: Sharp Kabushiki Kaisha, Osaka, Japan

[21] Appl. No.: 873,543

[22] Filed: Jun. 12, 1986

[30] Foreign Application Priority Data

| | | | |
|---|---|---|---|
| Jun. 14, 1985 | [JP] | Japan | 60-130508 |
| Jun. 14, 1985 | [JP] | Japan | 60-90579[U] |
| Jul. 8, 1985 | [JP] | Japan | 60-151139 |
| Jul. 12, 1985 | [JP] | Japan | 60-154495 |

[51] Int. Cl.[4] ..... G03G 15/00

[52] U.S. Cl. ..... 355/3 SH; 355/3 R; 355/14 SH; 271/288

[58] Field of Search ..... 355/3 SH, 3 R, 14 SH, 355/14 R; 271/288, 289, 290, 162, 3.1

[56] References Cited

U.S. PATENT DOCUMENTS

| | | | |
|---|---|---|---|
| 4,553,831 | 11/1985 | Dixon | 355/3 SH |
| 4,561,765 | 12/1985 | Masuda | 355/14 SH |
| 4,566,782 | 1/1986 | Britt et al. | 355/14 SH |
| 4,569,582 | 2/1986 | Hyltoft | 355/3 R |
| 4,585,333 | 4/1986 | Yamagishi | 335/14 R |

*Primary Examiner*—A. C. Prescott

*Attorney, Agent, or Firm*—Birch, Stewart, Kolasch & Birch

[57] ABSTRACT

A document copying system which is arranged to automatically collect copied paper sheets accommodated in a sorter in a classified state upon completion of the copying function for one original document group, and also to collect discharged original documents, capable of continuously effecting the copying operation including the classification work with respect to the plurality of original document groups, thus making it possible to realize an unattended copying operation over a long period of time.

4 Claims, 9 Drawing Figures

DOCUMENT COPYING SYSTEM

BACKGROUND OF THE INVENTION

The present invention generally relates to a document copying system for use in a copying apparatus equipped with an automatic document feeder and a sorter, and more particularly, to a document copying system arranged to effect a copying operation including classification work for collation and separation with respect to a plurality of original document groups.

The document copying system according to the present invention is provided with a document accumulating apparatus disposed in the vicinity of the sorter in order to continuously effect the copying operation including the classification work with respect to a plurality of original document groups, and by rendering drive means to be effective upon termination of the copying function with respect to one original document group, copied paper sheets accommodated in the sorter are collected onto an accumulating tray.

Generally, in a copying system in which an automatic document feeder is provided on an original document platform of a copying apparatus main body, with a sorter being mounted at a copy paper sheet discharge section thereof, original documents placed on the original document tray of the automatic document feeder are fed onto the original document platform one sheet by one sheet, and copy paper sheets completed for the copying function related to the original document are classified into respective bins provided in the sorter for accommodation. Thereafter, the original document on the original document platform is discharged outside, and the next original document is fed from the original document tray onto the original document platform so as to effect a similar copying function and accommodating function. Accordingly, in the copying system as described above the, copying operation including the classification work with respect to a plurality of original document sheets may be simplified, particularly without requiring manipulation by an operator during the copying operation. Moreover, there has also been proposed a system so arranged that original documents are placed on the original document tray, while a pre-engaged or preset sheet in which data such as copying mode, number of sheets to be copied, copying magnification, etc. are written by a so-called mark sheet system or the like, is disposed at a leading position of each original document group, and the data written on the preset data sheet are read by a reader disposed at an original document feeding section so as to effect the copying function based on the data thus read. By the system as described above, it is possible to effect copying operations for a plurality of original document groups, without the necessity for manual input of data by the operator.

However, in the conventional copying systems as described so far, until completion of collection by the operator of copied paper sheets classified and accommodated in the respective bobbins after termination of copying operation including the classification work, the next copying operation including the classification work can not be effected. Therefore, with respect to the plurality of original document groups which are to be subjected to the copying operation by utilizing the function of the sorter, it is impossible to effect the copying operation continuously. Moreover, there is also such a disadvantage that the operator must take out the copied paper sheets from the respective bins upon completion of the copying function including the classification work with respect to one original document group, thus hindering acceleration of labor savings and preventing an unattended operation. Furthermore, also with respect to the original documents discharged from the automatic document feeder after completion of the copying operation, they must be collected by the operator after completion of the copying function for one original document group, and there was such a drawback that in the case where the original document is left uncollected by mistake, an original document in the subsequent copying operation is undesirably mixed with the uncollected original document.

SUMMARY OF THE INVENTION

Accordingly, an essential object of the present invention is to provide a document copying system which is arranged to automatically collect copied paper sheets accommodated in a sorter in a classified state upon completion of the copying function for one original document group and also to collect discharged original documents, and capable of continuously effecting the copying operation including the classification work with respect to the plurality of original document groups, thus making it possible to realize an unattended copying operation over a long period of time.

Another important object of the present invention is to provide a document accumulating apparatus for use in a document copying system of the above described type, which is arranged to be capable of classifying copy paper sheets accommodated in the bins of the sorter according to the respective bins when such copied paper sheets are accumulated on an accumulating tray for simplification of sorting work of the classified copy paper sheets.

A further object of the present invention is to provide a document accumulating apparatus of the above described type which is capable of accumulating a large number of original document sheets on the accumulating tray in a stable state.

Still another object of the present invention is to provide a document accumulating apparatus of the above described type which is arranged to be capable of continuously effecting the copying operation including the classification work through utilization of the sorter, thereby to realize an unattended copying operation.

In accomplishing these and other objects, according to one preferred embodiment of the present invention, there is provided a document copying system including an automatic document feeder for feeding original documents placed on an original document tray onto an original document platform, and a sorter having a plurality of bins for accommodating therein, through classification, copied paper sheets discharged from a copy paper discharge section so as to effect copying operation based on data written on a preset data sheet disposed at a leading portion of each original document group, and characterized in that there are further provided an original document transport means for accommodating the original document discharged from the automatic document feeder into a particular bin of the sorter, and a document accumulating apparatus including an accumulating plate and an accumulating tray movably disposed for vertical movement respectively at opposite sides of said bins, an accumulating plate drive means and an accumulating tray drive means for vertically displacing said accumulating plate and tray, and an accumulating plate horizontal drive means for displacing said accumulating plate in a direction of said accumulating tray along the tray surface of each bin. The accumulating plate drive means, accumulating tray drive means and accumulating plate horizontal drive means are arranged to be made effective upon completion of the copying function with respect to one original document group, thereby to accumulate the original document and copied paper sheets accommodated in the sorter onto the accumulating tray.

By the above arrangement, according to the present invention, it is possible to collect the original documents and copied paper sheets accommodated in the respective bins of the sorter by causing the accumulating plate and accumulating tray to function upon completion of the copying operation with respect to one original document group. Accordingly, collection of copied paper sheets from the sorter and also collection of original documents from the paper discharge section by the operator may be omitted, and thus, the classification work can be continuously effected with respect to a plurality of original document groups, while the collection work of the original document is made positive, thereby realizing an unattended copying operation for a long period of time.

In another aspect of the present invention, there is provided a document accumulating apparatus disposed in the vicinity of the sorter having the plurality of bins vertically arranged in an overlapping manner for accommodating therein through classification, paper sheets copied at a copying apparatus main body, and including the accumulating tray and the accumulating plate movably disposed respectively at opposite sides of the bins for vertical displacement, and an accumulating plate horizontal displacing means for displacing the accumulating plate in a direction of the accumulating tray along the tray surface of each bin. The accumulating plate horizontal displacing means is provided with an accumulating plate displacing amount altering means for altering the displacing amount of the accumulating plate in the direction of the accumulating tray so as to be different from each other between neighboring bins.

By the above construction of the present invention, in the case where copied paper sheets accommodated in the bins of the sorter are accumulated on the accumulating tray upon completion of the copying operation including the classification treatment, the stopping position in the moving direction of the accumulating plate can be altered for each bin. Therefore, the copied paper sheets may be accumulated on the accumulating tray, with the state thereof classified according to the respective bins being maintained. Accordingly, in the case where the operator collects the copied paper sheets from the accumulating tray also, separation with respect to each group of the copied paper sheets as classified may be readily effected for the simplification of the copying operation.

In a further aspect of the present invention, there is provided a document accumulating apparatus disposed adjacent to a sorter having a plurality of bins vertically arranged in an overlapping manner, and including an accumulating plate and an accumulating tray movably disposed respectively at opposite sides of the bins for vertical displacement, to thereby to collect the documents accommodated in the bins by displacing the accumulating plate in a direction of the accumulating tray along the tray surface constituting the bin. The document accumulating apparatus further includes a document position detecting means for detecting the uppermost position of the documents accommodated in the accumulating tray, and an accumulating tray displacing amount control means for controlling the displacing amount of the accumulating tray so as to maintain the tray surface of each bin and the uppermost position of said documents at a constant interval based on the result of detection by the document position detecting means.

By the above arrangement, according to the present invention, it is possible to maintain the interval between the uppermost surface of the documents accommodated on the accumulating tray and the tray face of the bin constant at all times in the vertical direction. Therefore, the documents may be accommodated on the accumulating tray in a stable state irrespective of the number of documents contained in the bin, immediately after starting of the accumulating function.

In still another aspect of the present invention, there is provided a document accumulating apparatus disposed adjacent to a sorter having a plurality of bins vertically arranged in an overlapping manner so as to accommodate therein through classification, paper sheets copied at a copying apparatus main body. The document accumulating apparatus includes an accumulating tray and an accumulating plate movably disposed at opposite sides of the bins for vertical movement, an accumulating tray drive means and an accumulating plate drive means for vertically displacing the accumulating tray and the accumulating plate respectively, and an accumulating plate horizontal drive means for displacing the accumulating plate in a direction of the accumulating tray along the tray surface of each bin.

By the construction of the present invention as described above, it is possible to collect the copied paper sheets accommodated in the respective bins of the sorter, into the interior of the accumulating tray by the functions of the accumulating tray and accumulating plate. Accordingly, since the sorter may be used for the subsequent copying operation immediately after completion of the collecting work, the copying operation including the classification work may be continuously effected with respect to a plurality of original document groups, thus expediting the unattended copying operation.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
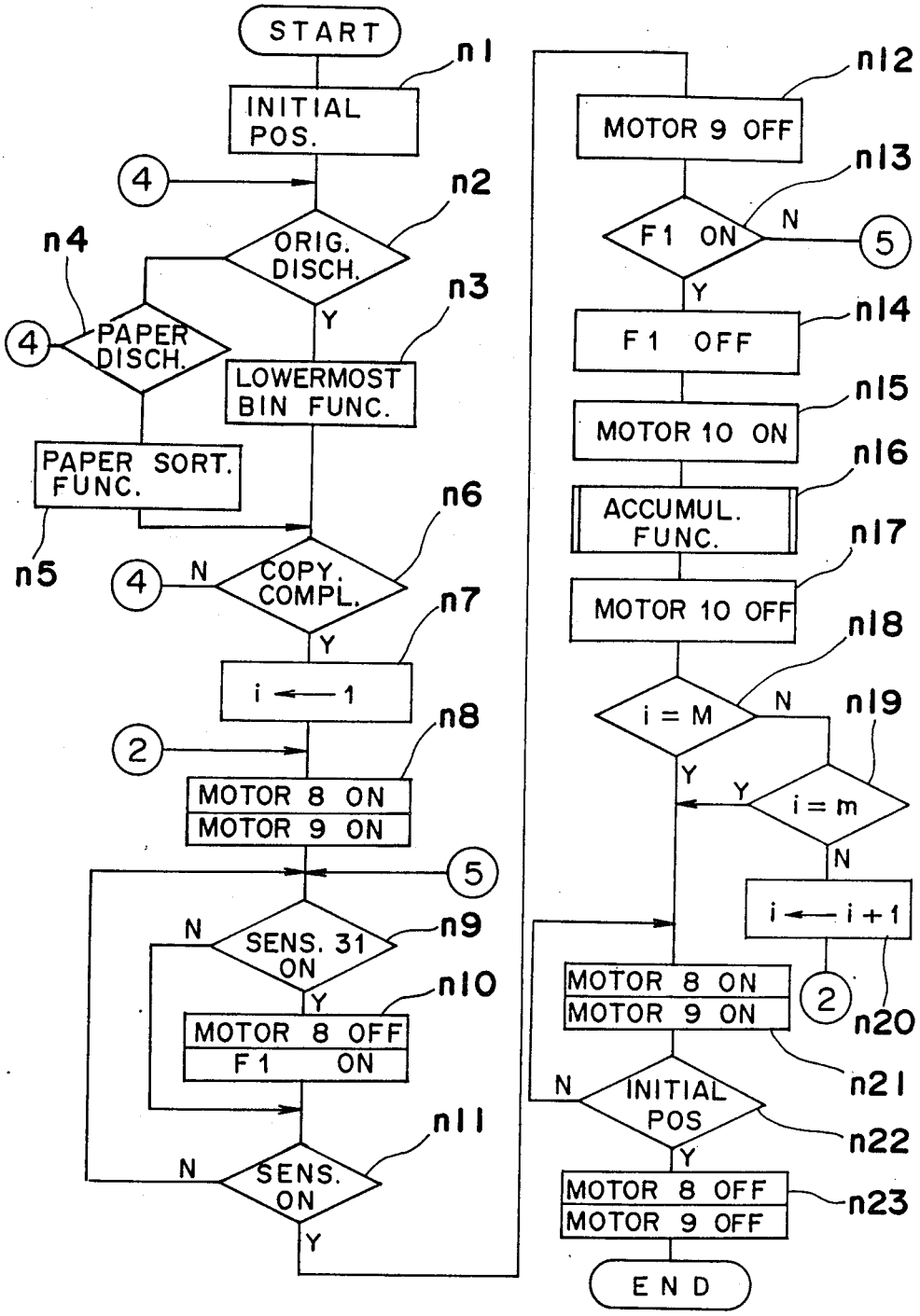
FIGS. 1(A) and 1(B) are flow-charts representing functions of a document accumulating apparatus according to the present invention.
Figure 1:
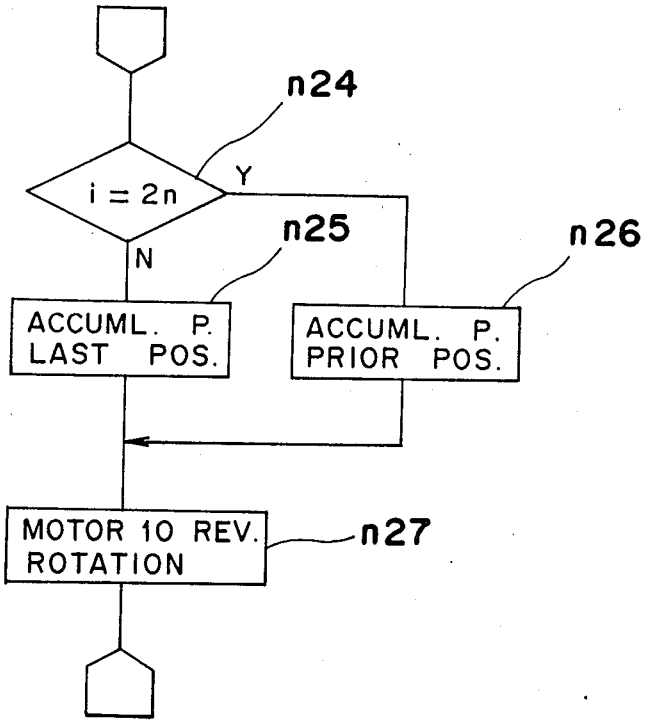

Before the description of the present invention proceeds, it is to be noted that like parts are designated by like reference numerals throughout the accompanying drawings.

Figure 3:
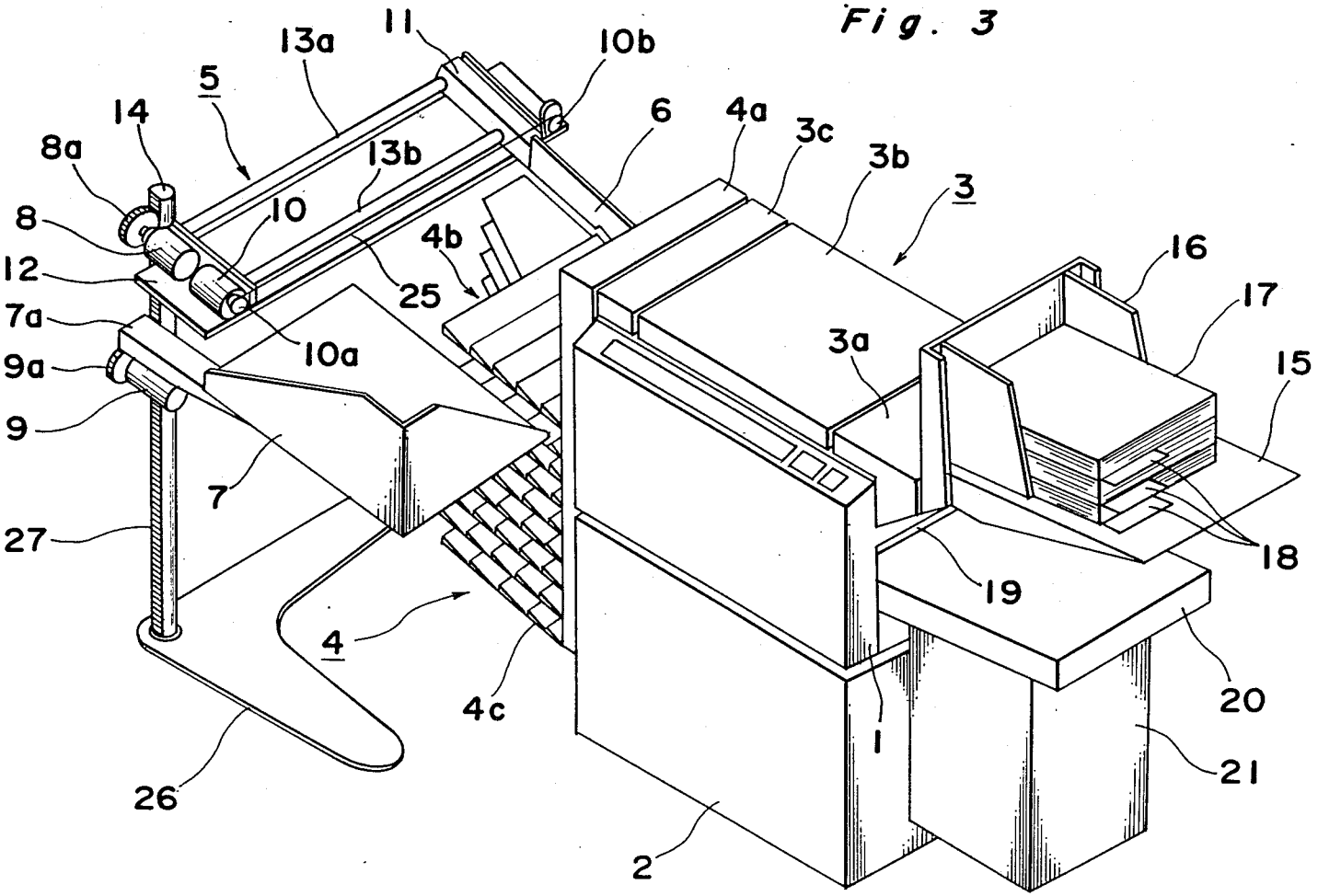
FIG. 3 is a perspective view showing a general appearance of the copying apparatus provided with the document accumulating apparatus of the present invention.

Referring now to the drawings, there is shown in FIG. 3, a copying system provided with a document accumulating apparatus according to the present invention.

In FIG. 3, the copying system generally includes a cabinet 2, a copying apparatus main body 1 mounted on the cabinet 2, an automatic document feeder 3 provided on the upper surface of the main body 1, a sorter 4 disposed at the left side of the main body 1, and copy paper cassettes 20 and 21 attached to the right side of the main body 1. The copy paper cassette 21 provided at a paper feeding section 19 of the copying apparatus main body 1 is a large-sized cassette capable of accommodating about 1500 copy paper sheets so as to correspond to a continuous copying operation of a large number of copy paper sheets.

The automatic document feeder 3 mounted on the upper surface of the copying apparatus main body 1 includes an original document feeding section 3*a*, an original document transport section 3*b*, and an original document discharge section 3*c*. The original document feeding section 3*a* is mounted with an original document tray 15 which is provided with a pair of spaced regulating plates 16 for regulating the position of the mounted sheets in a stack. The original documents 17 placed on the tray 15 are successively fed onto the original document platform (not particularly shown) on the upper surface of the main body 1 from the sheet located at the lowermost position of the stack. The original document tray 15 is adapted to be capable of mounting a large number of original document sheets, while the stack of the original documents 17 includes a plurality of kinds of original document groups, with a preset data sheet 18 being placed at a leading position of each kind of original document group. In the above preset data sheet 18, data such as the set number of sheets, etc. are written in a so-called "mark sheet system". The data, i.e., contents of the preset data sheet 18 are read off at the original document feeding section 3*a* of the automatic document feeder 3 so as to control the copying operation thereafter.

The sorter 4 is attached to a paper discharge section of the copying apparatus main body 1, and generally includes a copy paper transport section 4*a* and bins 4*b* vertically arranged in an overlapping manner, with the bin 4*c* located at the lowermost position being utilized as a discharge section of the original document. In such a manner as to surround bins 4*b* of the sorter 4, there is provided the document accumulating apparatus 5 which includes an accumulating plate 6 and an accumulating tray 7 located at opposite sides of the bins. The accumulating plate 6 is fixed to a support member 11 through which two guide shafts 13*a* and 13*b* mounted on a fixing plate 12 are inserted. At one side on the fixing plate 12, there is mounted a DC servo-motor 10, with a pulley 10*a* being fixedly mounted on its rotary shaft. At the other side of the fixing plate 12, a pulley 10*b* is rotatably provided, and a wire 25 is passed around pulleys 10*a* and 10*b*. The opposite ends of the wire 25 are secured to the support member 11. By the above construction, the support member 11 moves on the fixing plate 12 along the guide shafts 13*a* and 13*b* through rotation of the DC servo-motor 10. Based on the above function, the accumulating plate 6 is displaced with respect to the accumulating tray 7 along the tray face of each bin 4*b*. On the one side of the fixing plate 12 in a position adjacent to the DC servo-motor 10, there is disposed another DC servo-motor 8, with a gear 8*a* being fixed on a rotary shaft thereof. Meanwhile, on a holding member 7*a* for holding the accumulating tray 7, a DC servo-motor 9 is mounted, with a gear 9*a* being fixed to its rotary shaft. Each of the gears 8*a* and 9*b* is engaged with a rack gear 27 formed on a pole 14 secured to a base 26. By the above construction, through rotation of the DC servo-motors 8 and 9, the fixing plate 12 and the holding member 7*a* are displaced vertically with respect to the pole 14. Accordingly, the accumulating plate 6 and the accumulating tray 7 are vertically moved at opposite sides of the bins 4*b*.

It is to be noted here that each of the fixing plate 12 and the holding member 7*a* is positioned in the horizontal direction by a support mechanism (not shown).

Figure 4:
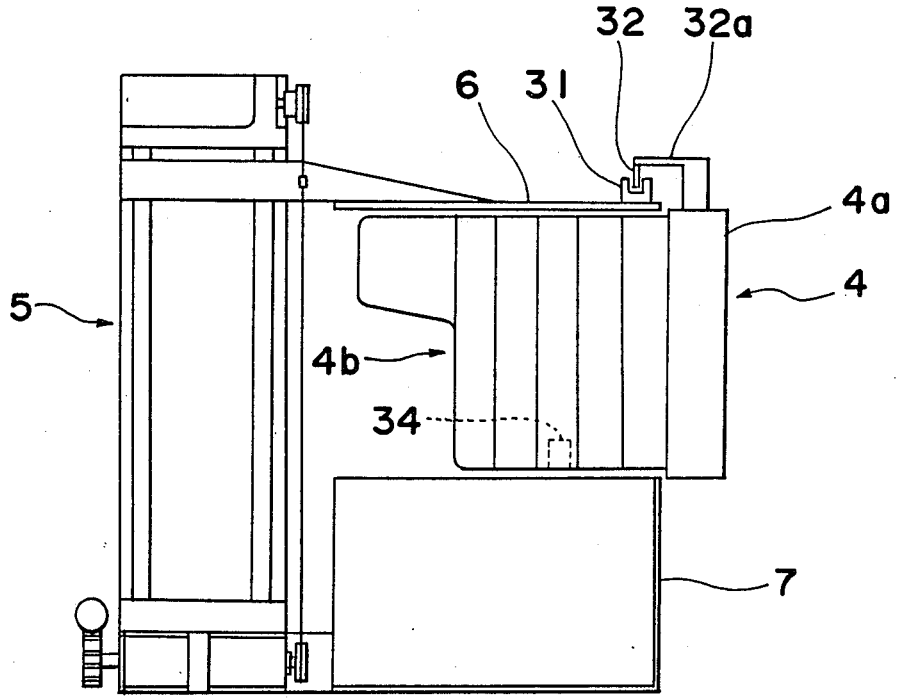
FIG. 4 is a top plan view of the document accumulating apparatus referred to above and the sorter attached to the copying apparatus.

Referring also to FIG. 4 showing a top plan view of the document accumulating apparatus and the sorter referred to above, on a side face of the accumulating plate 6, not confronting the bins 4*b*, there is fixedly mounted a photo-sensor 31, which is arranged to detect a slit plate 32 attached to the copy paper transport section 4*a* of the sorter through a fixing member 32*a*. The slit plate 32 is formed with slits in positions corresponding to the position of the bin 4*b*. At the reverse side of the tray face of the bin 4*b*, there is provided a photo-sensor 34 which is arranged to detect the accumulating tray 7.

Figure 5:
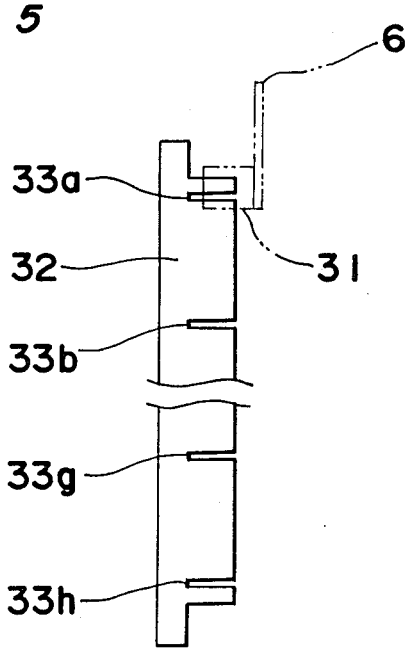
FIG. 5 is a fragmentary diagram showing functions of a photo-sensor provided on an accumulating plate constituting part of the above document accumulating apparatus.

Reference is further made to FIG. 5 illustrating the slit plate 32 which is to be detected by the photo-sensors 31 provided on the document accumulating apparatus referred to above.

The slit plate 32 is formed with slits 33*a* through 33*h* in positions corresponding to the bins 4*b* of the sorter 4. As the accumulating plate 6 is shifted vertically along the side portion of the bins 4*b*, the photo-sensor 31 is turned on when the photo-sensor 31 is aligned with the position of the slits 33*a* through 33*h*, to thereby to detect the present position of the accumulating plate 6.

Figure 6:
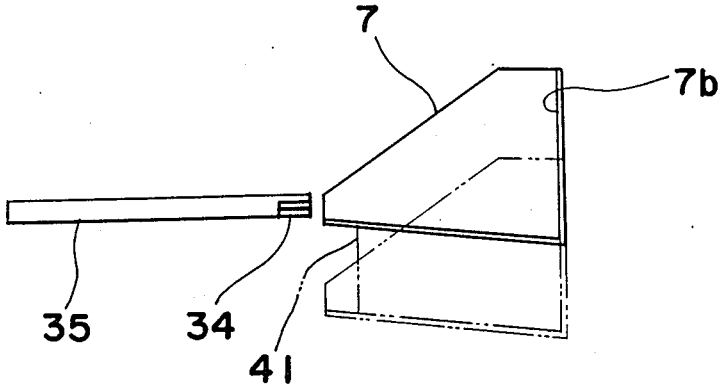
FIG. 6 is a diagram for explaining the function of a photo-sensor provided on a sorter mounted on the copying apparatus which employs the document accumulating apparatus.

Referring further to FIG. 6, on the reverse surface of the tray face 35 of the bin 4*b* in a position at its end portion facing the accumulating tray 7, there is disposed the photo-sensor 34, which further includes a light emitting element for projecting light onto a vertical wall 7*b* of the accumulating tray 7, and a light receiving element for receiving light reflected from said vertical wall 7*b*. Accordingly, in the case where no sheets are placed on the accumulating tray 7, the photo-sensor 34 detects the accumulating tray 7 in a state as shown by solid lines, while when sheets 41 are placed on the accumulating plate 7, the photo-sensor 34 detects the accumulating tray 7 in the state as indicated by two-dotted chain lines.

Figure 7:
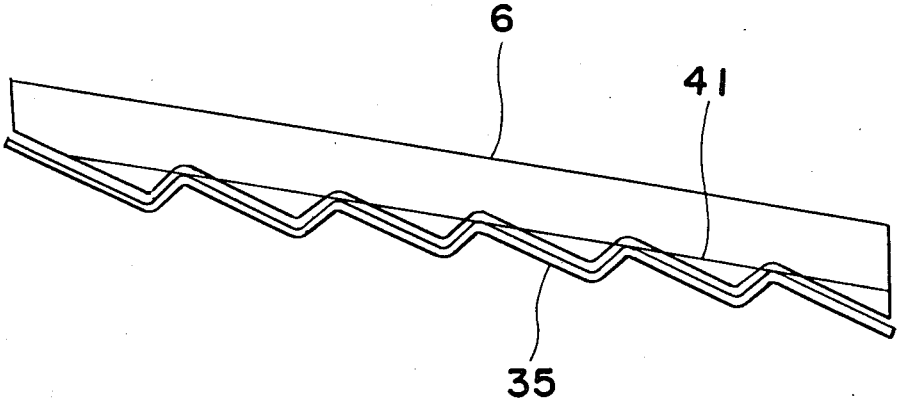
FIG. 7 is a fragmentary front elevational view of a tray face constituting part of the sorter.

In FIG. 7, there is shown a fragmentary front elevational view for representing the configuration of the tray face constituting each bin of the sorter to which the document accumulating apparatus of the present invention may be applied.

On the tray face 35 constituting each bin 4*b*, there are formed a plurality of recesses arranged in a direction of displacement of the accumulating plate 6. Similarly, the accumulating plate 6 is also formed with projecting portions which may engage the recesses of the tray face 35. By the above construction, even in the case where one sheet of the original document 41 is accommodated on the tray face 35, such a sheet 41 may be displaced in the direction of the accumulating tray 7 through movement of the accumulating plate 6.

Figure 8:
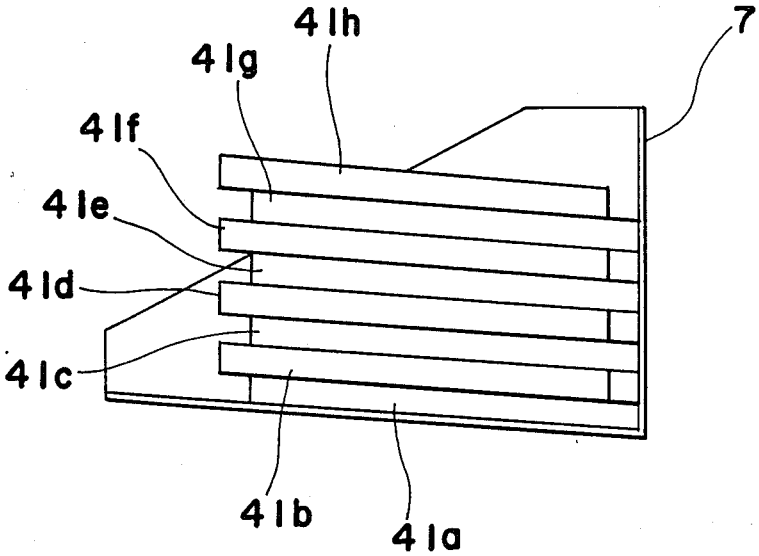
FIG. 8 is a fragmentary side elevational view showing the state of accumulation of copy paper sheets on an accumulating tray constituting part of the document accumulating apparatus.

FIG. 8 shows a fragmentary side elevational view in which sheets are accumulated on the accumulating tray constituting part of the document accumulating apparatus.

By altering the amount of displacement of the accumulating plate 6 toward the accumulating tray 7 one step by one step, the paper sheets 41*a* through 41*h* may be accumulated through classification according to the respective bins in which they are accommodated, by which collecting work after the copying operation can be effected extremely easily in an efficient manner.

Referring further to flow-charts of FIGS. 1(A), 1(B) and 2, functionings of the document copying system described so far will be explained hereinbelow.

In the flow-chart of FIG. 1(A) representing the functions of the document accumulating apparatus of the present invention, the accumulating plate 6 and the accumulating tray 7 constituting part of the document accumulating apparatus are stopping at an initial position, located above the uppermost bin before starting of the functioning at step n1. When the original document or copy paper sheet is discharged from the automatic document feeder 3 or copying apparatus main body 1 in the direction of the sorter 4, it is checked at step n2 whether or not the original document is discharged. In the case where the original document is discharged from automatic document feeder 3, the procedure proceeds to step n3 so as to accommodate the original document in the lowermost bin 4*c* of the sorter 4. When the original document is not discharged, the step is shifted to step n4 to see whether or not any copy paper sheet is discharged. If the copy paper sheet has been discharged, the procedure proceeds to step n5, where it is detected how many sheets precede the discharged copy paper sheet with respect to the same original document, and the copy paper sheet is accommodated into the bin corresponding thereto. By repeating the functions for steps n2 to n5 during the copying operation, collating work of the paper sheets copied with the image of the original document is effected, while the original document is accommodated in the lowermost bin of the sorter 4. At step n6, upon completion of the copying function, the procedure proceeds to step n7, and the content of a counter i is set to "1". This counter i is intended to show the position from the uppermost position of the bin where the accumulating plate 6 and accumulating tray 7 are stopping. Subsequently, at step n8, the DC servo-motors 8 and 9 are turned on so as to move the accumulating plate 6 and the accumulating tray 7 downwardly. At step n9, when the photo-sensor 31 has detected the slit of the slit plate 32, the step proceeds to step n10, to turn off the DC servo-motor 8, and also to turn on a flag F1, which is intended to indicate the state of functioning of the DC servo-motor 8. Then, at step n11, it is checked whether or not the photo-sensor 34 is turned on. If the photosensor is brought into an "on" state through detection of the accumulating tray 7, the procedure proceeds to step n12 to turn off the DC servo-motor 9. Subsequently, at step n13, it is judged whether or not the flag F1 is on, and if it is not in the "on" state, the step reverts to step n9. In the case where the sensor 31 is not in the "on" state at step n9, the procedure directly proceeds to step n11, while when the sensor 34 is not in the "on" state, the step is returned to step n9. By the above functions in steps n8 through n13, it is possible to displace the accumulating plate 6 and accumulating tray 7 from the initial position to the position of the bin at a first stage or a subsequent stage.

At step n13, in the case where the flag F1 is in the "on" state, i.e., when the accumulating plate 6 and the accumulating tray 7 have been displaced up to the predetermined positions, the procedure proceeds to step n14 to turn off the flag F1. Subsequently, at step n15, the DC servo-motor 10 is turned on, and at step n16, the accumulating plate 6 is displaced toward the accumulating tray 7. After displacing the accumulating plate 6 up to the predetermined position, the DC servo-motor 10 is rotated in the reverse direction to return the accumulating plate 6 to the original position. After completion of the above function, at step n17, the DC servo-motor 10 is turned off. Subsequently, at step n18, it is judged whether or not the content of the counter i agrees with the total number M of the bins disposed in the sorter 4 in the overlapping manner. When both do not agree with each other at step n18, it is judged at step n19, whether or not the content of the counter i is equal to the set number m of sheets to be copied. In the case where the content of the counter i and the set number m of the sheets to be copied do not agree with each other at step n19, the procedure proceeds to step n20 to add "1" to the content of the counter i, and then, the procedure returns to step n8. By repeating the functions of steps n8 to n20, the accumulating plate 6 and the accumulating tray 7 are shifted to the position of the lower bin by one step, thereby to collect the accommodated paper sheets onto the accumulating tray 7.

In the case where the content of the counter i coincides with the total number M of the bins 4*b* at step n18 or the content of the counter i coincides with the number m of copies to be taken at step n19, the procedure proceeds to step n21 to turn on the DC servo-motors 8 and 9 for moving the accumulating plate 6 and the accumulating tray 7 upwardly. At step n22, when the accumulating plate 6 and the accumulating tray 7 have reached the intial position, the procedure proceeds to step n23, and the DC servo-motors 8 and 9 are stopped to complete the functions.

FIG. 1(B) is a flow-chart showing the accumulating function of the accumulating plate constituting part of the document accumulating apparatus.

In the flow-chart of FIG. 1(A), the accumulating function of step n16 first judges whether or not the content of the counter i is of an even number at step n24. When the content of the counter i is of an odd number, the procedure proceeds to step n25 to displace the accumulating plate 6 to the final position. At step n24, if the content of the counter i is of an even number, the step is shifted to step n26, and the accumulating plate 6 is shifted to a position prior to the final position by about 20 mm. After completion of the functions at steps n25 and n26, the procedure is shifted to step n27, and the DC servo-motor 10 is reversed to return the accumulating plate to the initial position. The above functions in steps n24 to n27 correspond to the accumulating plate displacing amount altering means, and by these functions, the paper sheets are accumulated on the accumulating tray 7 in the state as shown in FIG. 8, and thus, when the paper sheets are collected from the accumulating tray 7, the work for classifying the paper sheets for each number as sorted in each bin may be readily effected.

Figure 2:
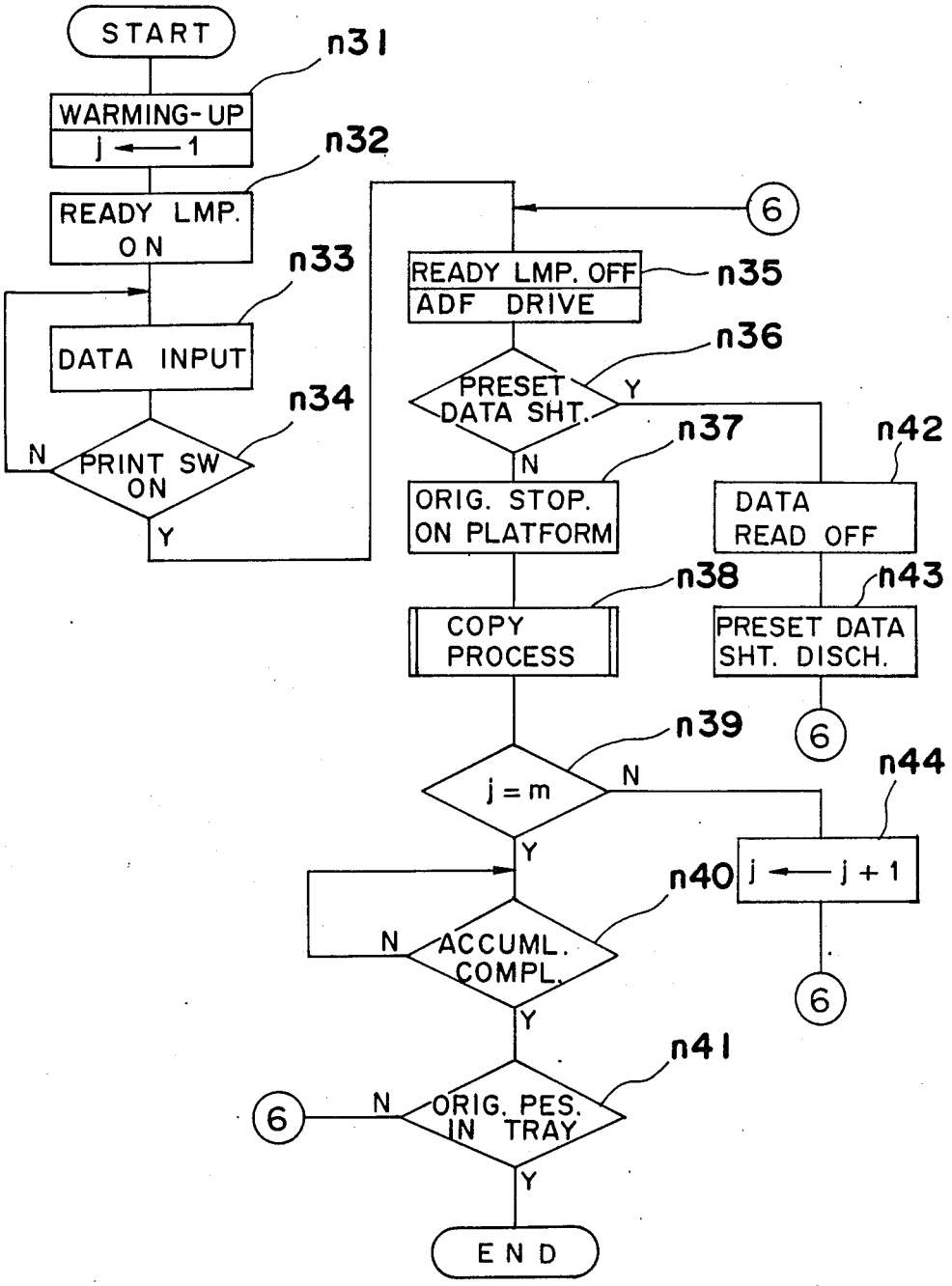
FIG. 2 is a flow-chart showing functions of a copying apparatus in which the document accumulating apparatus of FIGS. 1(A) and 1(B) is employed.

FIG. 2 is a flow-chart showing the function of the copying apparatus to which the document accumulating apparatus may be applied.

In FIG. 2, after turning on the power supply, warming-up is effected at step n31, with the content of the counter j rendered to be "1". The step is shifted to step n32 after completion of the warming-up, and the ready lamp is turned on. This ready lamp is intended to indicate that the starting of the copying operation is possible. Subsequently, at step n33, input of data is effected by the operator, and upon actuation of the print switch at step n34, the step proceeds to step n35, where the ready lamp is turned off, and the automatic document feeder 3 is operated to lead the original document to the original document platform. At step n36, it is judged whether or not the original document fed from the original document tray 15 is the preset data sheet 18, and if it is the preset data sheet 18, the data are read off in the original document feed section 3*a* at step n42, and the procedure is shifted to step n43 without effecting the copying function so as to return to step n35 after discharging of the sheet into the bin 4*c* at the lowermost position of the sorter.

At step n36, if the original document is not the preset data sheet 18, the procedure proceeds to step n37, and the original document is stopped on the original document platform of the copying apparatus main body 1 to effect the copying process at step n38. After completion of the copying process, it is judged at step n39, whether or not the content of the counter j is equal to the number m of copies to be taken, and if it is not equal, the content of the counter j is added with 1 at step n44 to return to step n35. At step n39, when the content of the counter j is equal to the number m of copies to be taken, the step proceeds to step n40 to wait for the completion of the accumulation treating function of the document accumulating apparatus. Upon completion of the accumulating function at step n40, the procedure proceeds to step n41, where it is judged whether or not the original document 17 or the preset data sheet 18 is remaining on the original document tray 15. At step n41, in the presence of the original document 17 or preset data sheet 18 on the original document tray 15, the procedure returns to step n35. By the foregoing function, when the preset data sheet 18 is fed in the direction of the original platform, the content thereof is read off by the original document feeding section 3*a*. Furthermore, based on the content thus read off, the data such as the number of sheets to be copied, copy paper sizes, etc. are controlled to effect the copying process. Accordingly, by disposing the preset data sheet 18 in which the data related to the copying function of the original document are written, at the leading position of each original document group, it is possible to collect the paper sheets accommodated in the sorter onto the accumulating tray upon completion of the copying operation for one original document group. Accordingly, the unattended copying operation including the collating work can be effected continuously with respect to a plurality of original document groups.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A document copying system including an automatic document feeder for feeding original documents placed on an original document tray onto an original document platform, and a sorter having a plurality of bins for accommodating therein, through classification, copied paper sheets discharged from a copy paper discharge section so as to effect a copying operation based on data written on a present data sheet disposed at a leading portion of each original document group, the improvement comprising:

original document transport means for accommodating the original document discharged from the automatic document feeder into one of said plurality of bins of the sorter; and a document accumulating apparatus including, an accumulating plate and an accumulating tray movably disposed for vertical movement respectively at opposite sides of said bins, accumulating plate drive means and accumulating tray drive means for vertically displacing said accumulating plate and tray, and accumulating plate horizontal drive means for displacing said accumulating plate in a direction of said accumulating tray along the tray surface of each bin, said accumulating plate drive means, said accumulating tray drive means and said accumulating plate horizontal drive means being made effective upon completion of the copying function with respect to one original document group to thereby accumulate the original document and copied paper sheets accommodated in the sorter onto said accumulating tray.

2. A document accumulating apparatus disposed in the vicinity of a sorter having a plurality of bins vertically arranged in an overlapping manner for accommodating therein through classification, paper sheets copied at a copying apparatus main body, comprising:

an accumulating tray and an accumulating plate movably disposed respectively at opposite sides of said bins for vertical displacement; and accumulating plate horizontal displacing means for displacing said accumulating plate in a direction of said accumulating tray along the tray surface of each bin;

said accumulating plate horizontal displacing means being provided with an accumulating plate displacing amount altering means for altering the displacing amount of said accumulating plate in the direction of said accumulating tray so as to be different from each other between neighboring bins.

3. A document accumulating apparatus disposed adjacent to a sorter having a plurality of bins vertically arranged in an overlapping manner, comprising:

an accumulating plate and an accumulating tray movably disposed respectively at opposite sides of said bins for vertical displacement, thereby collecting the documents accommodated in said bins by displacing said accumulating plate in a direction of said accumulating tray along the tray surface constituting said bin;

document position detecting means for detecting the uppermost position of the documents accommodated in said accumulating tray; and accumulating tray displacing amount control means for controlling the displacing amount of the accumulating tray so as to maintain the tray surface of each bin and the uppermost position of said documents at a constant interval, based on the result of detection by said document position detecting means.

4. A document accumulating apparatus disposed adjacent to a sorter having a plurality of bins vertically arranged in an overlapping manner so as to accommodate therein through classification, paper sheets copied at a copying apparatus main body, said document accumulating apparatus comprising:

an accumulating tray and an accumulating plate movably disposed at opposite sides of said bins for vertical movement;

accumulating tray drive means and accumulating plate drive means for vertically displacing said accumulating tray and said accumulating plate respectively; and accumulating plate horizontal drive means for displacing said accumulating plate in a direction of said accumulating tray along the tray surface of each bin.

* * * * *